US008884603B2

(12) United States Patent
Cheng

(10) Patent No.: US 8,884,603 B2
(45) Date of Patent: Nov. 11, 2014

(54) REFERENCE POWER SUPPLY CIRCUIT

(75) Inventor: Liang Cheng, Wuxi (CN)

(73) Assignees: CSMC Technologies FAB1 Co., Ltd., Wuxi (CN); CSMC Technologies FAB2 Co., Ltd., Wuxi (CN)

( * ) Notice: Subject to any disclaimer, the term of this patent is extended or adjusted under 35 U.S.C. 154(b) by 117 days.

(21) Appl. No.: 13/807,310

(22) PCT Filed: Nov. 29, 2011

(86) PCT No.: PCT/CN2011/083101

§ 371 (c)(1),
(2), (4) Date: Dec. 28, 2012

(87) PCT Pub. No.: WO2012/079454

PCT Pub. Date: Jun. 21, 2012

(65) Prior Publication Data

US 2013/0099770 A1 Apr. 25, 2013

(30) Foreign Application Priority Data

Dec. 15, 2010 (CN) ..... 2010 1 0589057

(51) Int. Cl.
*G05F 3/20* (2006.01)
*G05F 3/02* (2006.01)
*G05F 3/30* (2006.01)

(52) U.S. Cl.
CPC ... *G05F 3/02* (2013.01); *G05F 3/30* (2013.01)
USPC ..... 323/313

(58) Field of Classification Search
USPC ..... 323/312, 313, 314; 327/513, 519
See application file for complete search history.

(56) References Cited

U.S. PATENT DOCUMENTS

| | | | | |
|---|---|---|---|---|
| 4,263,519 | A * | 4/1981 | Schade, Jr. | 327/539 |
| 6,232,829 | B1 * | 5/2001 | Dow | 327/539 |
| 6,294,902 | B1 * | 9/2001 | Moreland et al. | 323/268 |
| 6,426,669 | B1 * | 7/2002 | Friedman et al. | 327/539 |
| 6,507,180 | B2 * | 1/2003 | Eguchi | 323/314 |
| 7,170,274 | B2 * | 1/2007 | Mukherjee et al. | 323/313 |
| 8,547,165 | B1 * | 10/2013 | Bernardinis | 327/513 |
| 8,680,840 | B2 * | 3/2014 | Iacob et al. | 323/313 |
| 2004/0245977 | A1 * | 12/2004 | Tran | 323/315 |
| 2014/0049244 | A1 * | 2/2014 | Dimitriu et al. | 323/313 |

* cited by examiner

*Primary Examiner* — Adolf Berhane
(74) *Attorney, Agent, or Firm* — Anova Law Group, PLLC

(57) ABSTRACT

A reference power supply circuit includes an adjustable resistance network and a bandgap reference power supply circuit, in which the adjustable resistance network includes a first resistor end and a second resistor end, the resistance between the first resistor end and the second resistor end varies with a process deviation; the bandgap reference power supply circuit connects the first resistor end with the second resistor end, for generating a positive proportional to absolute temperature current flowing through the first resistor end and the second resistor end and for outputting a reference voltage related to the positive proportional to absolute temperature current. The reference power supply circuit has the advantageous of high precision and good temperature drift characteristic.

12 Claims, 3 Drawing Sheets

REFERENCE POWER SUPPLY CIRCUIT

TECHNICAL FIELD

The present disclosure generally relates to electronic circuit technology, in particularly to a reference power supply circuit.

TECHNICAL BACKGROUND

A reference source can generate a reference voltage (VREF) and/or a reference current which is independent of power supply and techniques and have an assured temperature characteristic regards of the temperature varies. It would be a criteria to provide a reference source with a low temperature coefficient (TC), low power dissipation and high power supply rejection ratio (PSRR) in the design of integrate circuits, such as an analog-digital converter (ADC), a digital-analog converter (DAC), a dynamic random access memory (DRAM) and a flash memory.

Referring to FIG. 1, a bandgap reference power supply circuit which may carry a curvature compensation for the temperature characteristic. In the power supply circuit, a branch current flowing through a triode Q01 and a branch current flowing through a triode Q02 are positive proportional to absolute temperature (PTAT) currents, while a branch current flowing through resistors R01 and R02 and a branch current flowing through resistors R03 and R04 are negative PTAT currents. Due to the positive and negative PTAT current compensation, the reference voltage VREF has a well temperature drift characteristic. However, the reference voltage may not be very precise because a plurality of resistors is incorporated in the circuit. In case there is a variation in the fabrication process, particularly when the range of the machining angle is exceeded, the resistance of the resistors varies in a rather wide range, such that a significant deviation of the slope for the positive PTAT current to the negative PTAT current occurs, which further leads to the increasing of the PTAT and a lower precised VREF, thus cutting down the performance of the bandgap reference power supply circuit.

One solution for the problems described above is to carry out a second-order curvature compensation for the temperature characteristic to improve the precision of a VREF. Referring to FIG. 2, a bandgap reference power supply circuit with second-order curvature compensation adopting PTAT voltage compensation method is shown. The power supply circuit includes two bandgap reference voltage sources. A first bandgap reference voltage source includes triodes Q1, Q2, Q3 and Q4 and resistors R1, R2 and R3, for generating a PTAT current $I_{PTAT}$. A second bandgap reference voltage source includes triodes Q5, Q6, Q7 and Q8 and resistors R4, R5 and R6, for generating a reference voltage Vref of the first-order temperature compensation.

Referring to FIG. 2, when a voltage between a base and an emitter of a triode Q10 is lower than its on-state voltage, the two bandgap reference voltage sources are disconnected, and the output reference voltage Vref refers to $$Vref = V_{BE6} + \frac{V_T \ln n_2}{R_4}(R_4 + 2R_5 + 2R_6),$$

in which $V_{BE6}$ indicates the voltage between a base and an emitter of the triode Q6.

When the voltage between the base and the emitter of the triode Q10 is higher than its on-state voltage, both of the two bandgap reference voltage sources are communicated and the current $I_{PTAT}$ flowing through the triode Q10 can be referred as $I_{PTAT}=V_T \ln n_1/R_1$, therefore, the output reference voltage Vref is $$Vref = V_{BE6} + \frac{V_T \ln n_2}{R_4}(R_4 + 2R_5 + 2R_6) + \frac{V_T \ln n_1}{R_1}R_6.$$

The triode Q10 is conducted at a predetermined temperature T0, and is cut off when the temperature is lower than T0. The currents flowing through the resistors R3 and R6 both are the PTAT currents, which increased as the temperature rises. When the temperature is lower than T0, a voltage $V_{BE10}$ between the base and the emitter of the triode Q10 is:

$$V_{BE10} = 2\frac{V_T \ln n_1}{R_1}R_3 - 2\frac{V_T \ln n_2}{R_4}R_6,$$

in which $n_1=S_{Q2}/S_{Q1}$, $n_2=S_{Q6}/S_{Q5}$, $V_T$ is a threshold voltage, and $S_{Q1}$, $S_{Q2}$, $S_{Q5}$ and $S_{Q6}$ indicate the cross section areas of the triodes Q1, Q2, Q5 and Q6, respectively. Accordingly, when $n_1=n_2$ and $(R_3/R_1-R_6/R_4)>0$, $V_{BE10}$ is increased as the temperature rises. When the temperature equals to T0, $V_{BE10}$ is equal to the on-state voltage of Q10.

However, the bandgap reference power supply circuit in FIG. 2 has the following problems: (1) there is also a plurality of resistors adopted, when a deviation is caused by variation of the fabrication process, the the resistance of the resistors would widely differs, such that the error coming from the circuit itself may exceed the precision of the second-order curvature compensation, resulting in the failure of the second-order curvature compensation; (2) when the resistance of the resistor $R_{16}$ wide varies, the triode Q10 may fail to be conducted or there would be an offset for its on-state temperature point; (3) the PSRR performance of the circuit in high frequency section may become worse and therefore could not be incorporated in a high frequency analog circuits (for example, a high-speed ADC circuit); (4) the topological structure of the circuit is relatively complicated.

SUMMARY

A reference power supply circuit includes:

an adjustable resistance network including a first resistor end and a second resistor end, the resistance between the first resistor end and the second resistor end varies with a process deviation;

a bandgap reference power supply circuit connected the first resistor end with the second resistor end, for generating a positive proportional to absolute temperature current flowing through the first resistor end and the second resistor end and for outputting a reference voltage related to the positive proportional to absolute temperature current.

DESCRIPTION OF THE PREFERRED EMBODIMENTS

Figure 1:
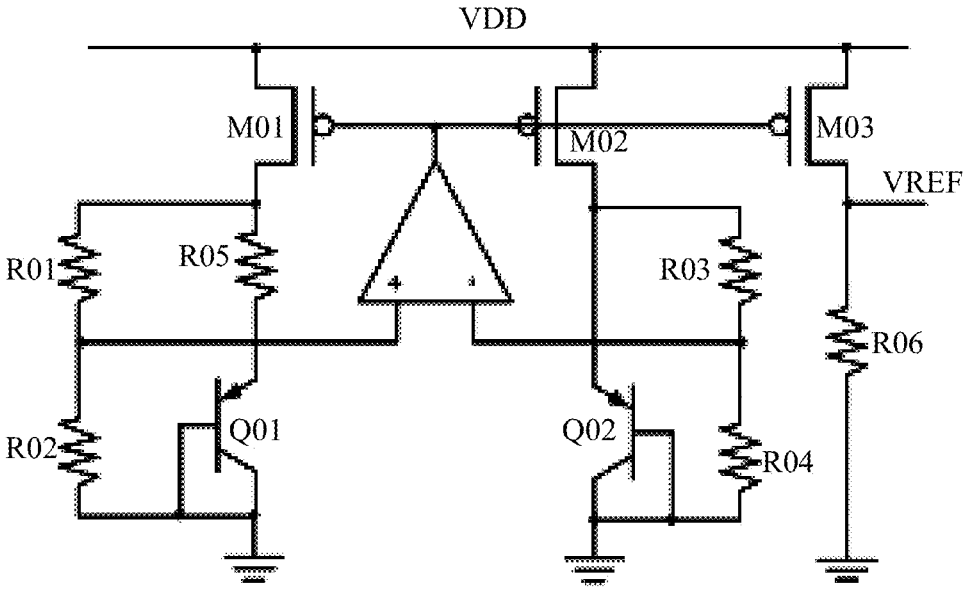
FIG. 1 is a schematic drawing of a bandgap reference power supply circuit incorporating a curvature compensation.
Figure 2:
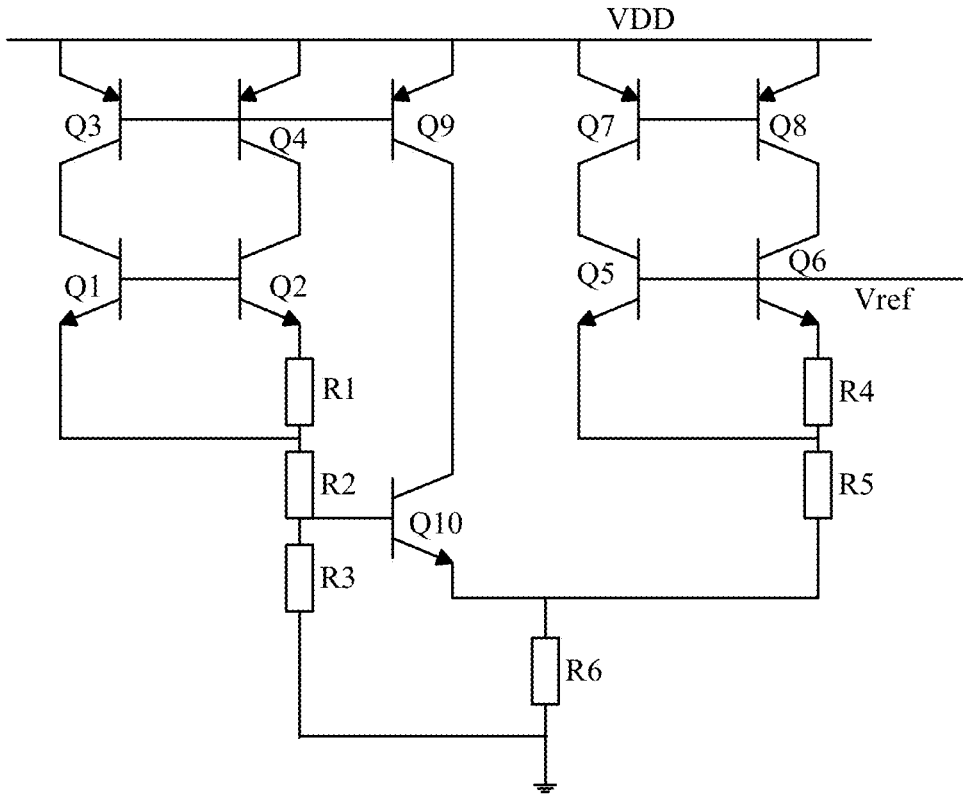
FIG. 2 is a schematic drawing of a bandgap reference power supply circuit with a second-order curvature compensation.
Figure 3:
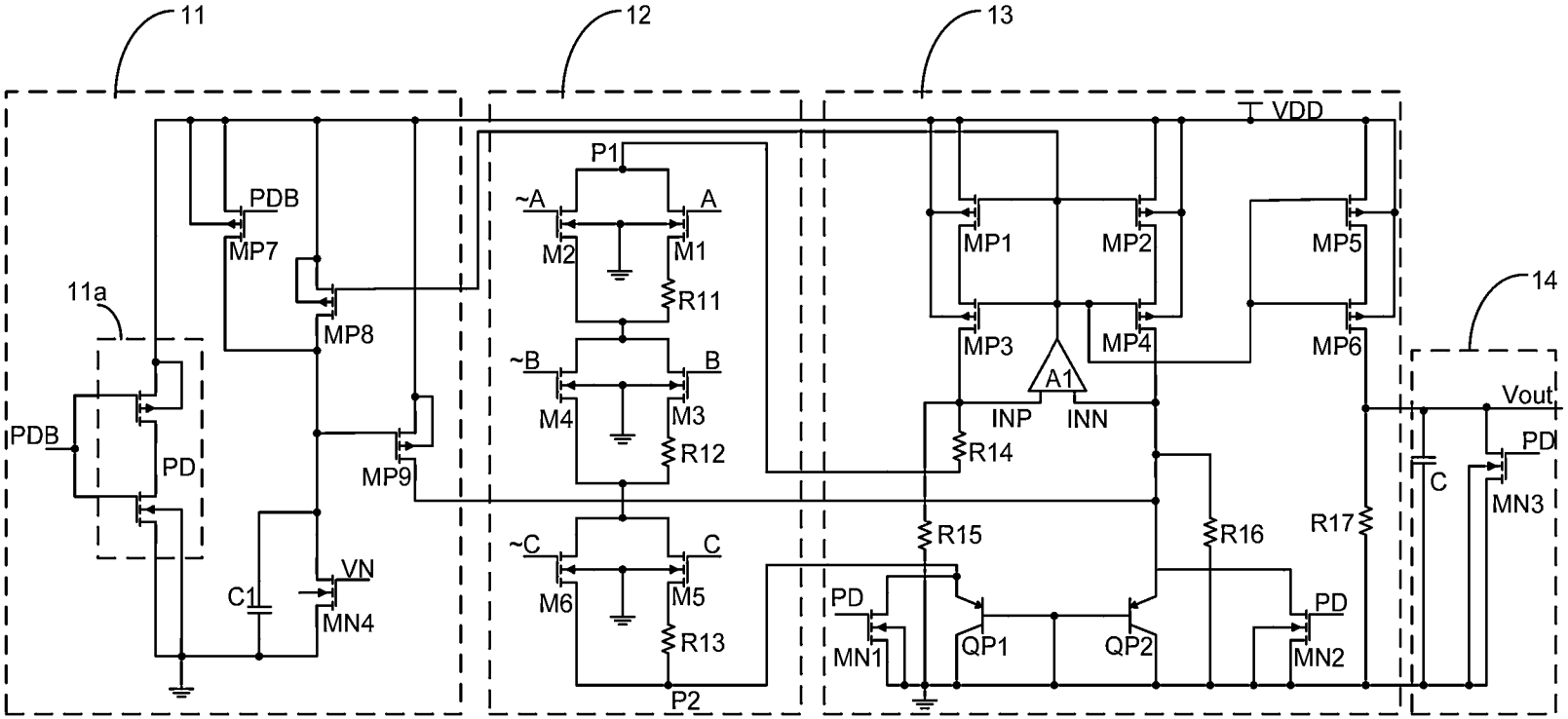
FIG. 3 is a schematic drawing of a reference power supply circuit according to an exemplary embodiment of the present disclosure.

FIG. 3 is a schematic drawing of the reference power supply circuit according to an exemplary embodiment, in which the reference power supply circuit at least includes an adjustable resistance network 12 and a bandgap reference power supply circuit 13.

The adjustable resistance network 12 includes a first resistor end P1 and a second resistor end P2, and the resistance between the first resistor end P1 and the second resistor end P2 can vary with the process deviation.

The adjustable resistance network 12 of the embodiment includes three sets of selection unit having identical structures for selecting resistors from those with different resistances to be connected, according to an input control signal. Each set of selection unit includes a resistor, two switch NMOS transistors. A pair of control signals being inversed with respect to each other may be applied to the selection unit. Specifically, the first set of the selection unit includes a first resistor R11, a first switch NMOS transistor M1, a second switch NMOS transistor M2; the second set of selection unit includes a second resistor R12, a third switch NMOS transistor M3, a fourth switch NMOS transistor M4; the third set of selection unit includes a third resistor R13, a fifth switch NMOS transistor M5, a sixth switch NMOS transistor M6. The pair of control signals that might be applied to the first set of selection unit is a first control signal A and a first inversed control signal ~A; the pair of control signals that might be applied to the second set of selection unit is a second control signal B and a second inversed control signal ~B; and the pair of control signals that might be applied to the third set of selection unit is a third control signal C and a third inversed control signal ~C.

For the first switch NMOS transistor M1, the first control signal A is connected at the gate, the drain is connected with the first resistor end P1 and the source is connected with a first end of the first resistor R11.

For the second switch NMOS transistor M2, the first inversed control signal ~A is fed at the gate, the drain thereof is connected with the first resistor end P1 and the source is connected with a second end of the first resistor R11.

For the third switch NMOS transistor M3, the second control signal B is connected at the gate, the drain is connected with the second end of the first resistor R11 and the source is connected with a first end of the second resistor R12.

For the fourth switch NMOS transistor M4, the second inversed control signal ~B is coupled at the gate, the drain is connected with the second end of the first resistor R11 and the source is connected with a second end of the second resistor R12.

For the fifth switch NMOS transistor M5, the third control signal C is coupled at the gate, the drain is connected with the second end of the second resistor R12 and the source is connected with a first end of the third resistor R13.

For the sixth switch NMOS transistor M6, the third inversed control signal ~C is connected at the gate, the drain is connected with the second end of the second resistor R12 and the source is connected with a second end of the third resistor R13 and the second resistor end P2.

The switch MOS transistors in the adjustable resistance network 12 may degrade the PSRR performance of the reference power supply circuit. Therefore, in practice, according to the actual technique situation, the switch NMOS transistors might be fabricated to have large area to reduce the influence on the PSRR performance. Moreover, the on-state resistance of the switch NMOS transistors might be less than 5% of the resistances of the resistors connected in series therewith. In detail, the on-state resistances of the first NMOS transistor M1 and the second NMOS transistor M2 are less than 5% of the resistance of the first resistor R11, the on-state resistances of the third NMOS transistor M3 and the fourth NMOS transistor M4 are less than 5% of the resistance of the second resistor R12, and the on-state resistances of the fifth NMOS transistor M5 and the sixth NMOS transistor M6 are less than 5% of the resistance of the third resistor R13.

The first control signal A, the second control signal B and the third control signal C might be set according to actual process deviation. The switch NMOS transistors are controlled to be on-state or off-state by the control signals, so as to get different combinations of the resistances between the first resistor end P1 and the second resistor end P2 of the adjustable resistance network 12. In the present embodiment, the corresponding relationship between the logic value of the control signals and resistance $R_0$ between the first resistor end P1 and the second resistor end P2 is shown in table 1, which is:

| No. | A | B | C | $R_0$ |
|---|---|---|---|---|
| (1) | 0 | 0 | 0 | 0 |
| (2) | 0 | 0 | 1 | $R_{13}$ |
| (3) | 0 | 1 | 0 | $R_{12}$ |
| (4) | 0 | 1 | 1 | $R_{12}+R_{13}$ |
| (5) | 1 | 0 | 0 | $R_{11}$ |
| (6) | 1 | 0 | 1 | $R_{11}+R_{13}$ |
| (7) | 1 | 1 | 0 | $R_{11}+R_{12}$ |
| (8) | 1 | 1 | 1 | $R_{11}+R_{12}+R_{13}$ |

In the present embodiment, the relation of the resistance $R_{11}$ of the first resistor R11, the resistance $R_{12}$ of the first resistor R12 and the resistance $R_{13}$ of the first resistor R13 is $R_{12}>R_{13}>R_{11}$, such that the adjustable range of the resistance between the first resistor end P1 and the second resistor end P2 could be increased.

The resistance $R_0$ is corresponding to "(3)" in table 1, when there is no process deviation.

When the integrated resistance of the resistors in the circuit is relatively high duo to the process deviation (for example, the process corner deviating from tt to ss), there are three ways for reducing the resistance $R_0$, which are:

(A1) turning off the first switch NMOS transistor M1, the third switch NMOS transistor M3 and the fifth switch NMOS transistor M5, and turning on the second switch NMOS transistor M2, the fourth switch NMOS transistor M4 and the sixth switch NMOS transistor M6, which are corresponding to the "(1)" in table 1;

(A2) turning off the first switch NMOS transistor M1, the third switch NMOS transistor M3 and the sixth switch NMOS transistor M6, and turning on the second switch NMOS transistor M2, the fourth switch NMOS transistor M4 and the fifth switch NMOS transistor M5, which are corresponding to the "(2)" in table 1;

(A3) turning off the second switch NMOS transistor M2, the third switch NMOS transistor M3 and the fifth switch NMOS transistor M5, and turning on the first switch NMOS transistor M1, the fourth switch NMOS transistor M4 and the sixth switch NMOS transistor M6, which are corresponding to the "(5)" in table 1;

When the integrated resistance of the resistors in the circuit is relatively low duo to the process deviation (for example, the process corner deviating from tt to ff), there are three ways for increasing the resistance $R_0$, which are:

(B1) turning off the first switch NMOS transistor M1, the fourth switch NMOS transistor M4 and the sixth switch NMOS transistor M6, and turning on the second switch NMOS transistor M2, the third switch NMOS transistor M3 and the fifth switch NMOS transistor M5, which are corresponding to the "(4)" in table 1;

(B2) turning off the second switch NMOS transistor M2, the fourth switch NMOS transistor M4 and the fifth switch NMOS transistor M5, and turning on the first switch NMOS transistor M1, the third switch NMOS transistor M3 and the sixth switch NMOS transistor M6, which are corresponding to the "(7)" in table 1;

(B3) turning off the second switch NMOS transistor M2, the fourth switch NMOS transistor M4 and the sixth switch NMOS transistor M6, and turning on the first switch NMOS transistor M1, the third switch NMOS transistor M3 and the fifth switch NMOS transistor M5, which are corresponding to the "(8)" in table 1.

"(6)" in table 1 can be a method for reducing or increasing the resistance $R_0$ which depends on whether the "$(R_{11}+R_{13})$" is greater than $R_0$.

It should be understood by those skilled in the art that, according to corresponding relationship among the process deviation, the control signal and the resistance $R_0$ described above, the first control signal A, the second control signal B and the third control signal C can be obtained by adopting a digital circuit design (for example, a decoding circuit), and thus the circuit for generating the first control signal A, the second control signal B and the third control signal C will not be described in detail herein.

The bandgap reference power supply circuit 13 of the embodiment includes a first PMOS transistor MP1, a second PMOS transistor MP2, a third PMOS transistor MP3, a fourth PMOS transistor MP4, a fifth PMOS transistor MP5, a sixth PMOS transistor MP6, an operational amplifier A1, a fourth resistor R14, a fifth resistor R15, a sixth resistor R16, a seventh resistor R17, a first NMOS transistor MN1, a second NMOS transistor MN2, a first PNP transistor QP1, and a second PNP transistor QP2.

For the first PMOS transistor MP1, the gate is connected with the output end of the operational amplifier A1, the source is connected with a reference voltage source VDD, and the drain is connected with the source of the third PMOS transistor MP3.

For the second PMOS transistor MP2, the gate is connected with the output end of the operational amplifier A1, the source is connected with the reference voltage source VDD, and the drain is connected with the source of the fourth PMOS transistor MP4.

For the third PMOS transistor MP3, the gate is connected with the output end of the operational amplifier A1, the source is connected with the drain of the first PMOS transistor MP1, and the drain is connected with the positive input end of the operational amplifier A1.

For the fourth PMOS transistor MP4, the gate is connected with the output end of the operational amplifier A1, the source is connected with the drain of the second PMOS transistor MP2, and the drain is connected with the negative input end of the operational amplifier A1.

A first end of the fourth resistor R14 is connected with the drain of the third PMOS transistor MP3, and a second end thereof is connected with the first resistor end P1 of the adjustable resistance network 12.

A first end of the fifth resistor R15 is connected with the drain of the third PMOS transistor MP3, and a second end thereof is grounded.

A first end of the sixth resistor R16 is connected with the drain of the fourth PMOS transistor MP4, and a second end thereof is grounded.

For the first NMOS transistor MN1, a first bias voltage PD is inputted at the gate, the drain is connected with the second resistor end P2 of the adjustable resistance network 12, and a source is grounded.

For the second NMOS transistor MN2, the first bias voltage PD is inputted at the gate, the drain is connected with the drain of the fourth PMOS transistor MP4, and the source is grounded.

For the first PNP transistor QP1, the emitter is connected with the drain of the first NMOS transistor MN1, and the base and the collector are grounded.

For the second PNP transistor QP2, the emitter is connected with the drain of the second NMOS transistor MN2, and the base and the collector are grounded.

For the fifth PMOS transistor MP5, the gate is connected with the output end of the operational amplifier A1, the source is connected with the reference voltage source VDD, and the drain is connected with a source of the sixth PMOS transistor MP6.

For the sixth PMOS transistor MP6, the gate is connected with the output end of the operational amplifier A1, the source is connected with the drain of the fifth PMOS transistor MP5, and the drain is used as an output end of a reference voltage Vout.

A first end of the seventh resistor R17 is connected with the drain of the sixth PMOS transistor MP6, and a second end thereof is grounded.

The adjustable resistance network 12 is connected in series between the fourth resistor R14 and the first PNP transistor QP1 of the bandgap reference power supply circuit 13, and the current flowing through the adjustable resistance network 12 is the PTAT current.

When there is no process deviation, the first switch NMOS transistor M1, the fourth switch NMOS transistor M4 and the fifth switch NMOS transistor M5 are turned off, and the second switch NMOS transistor M2, the third switch NMOS transistor M3 and the sixth switch NMOS transistor M6 are turned on, the PTAT current flows through the second resistor R12. In this case, a best temperature drift characteristic is obtained and the top point of the TC characteristic curve situates at the middle point of the testing temperature range.

When the process deviation occurs, the PTAT current can be adjusted to be increased or decreased, in which:

when the integrated resistance of the resistors in the circuit are relatively high due to the process deviation (for example, the process corner deviating from tt to ss), the PTAT current can be adjusted by reducing the resistance $R_0$ in three ways which are respectively corresponding to the "(1)", "(2)" or "(5)" in table 1, and thus the resistance of the adjustable resistance network 12 is reduced. In other words, the resistances of the resistors in the PTAT current branch of the bandgap reference power supply circuit 13 are reduced, therefore the PTAT current is increased and the top point of the TC characteristic curves can move towards the low temperature area;

When the integrated resistance of the resistors in the circuit are relatively low due to the process deviation (for example, the process corner deviating from tt to ff), the PTAT current can be adjusted by increasing the resistance $R_0$ in three ways which are respectively corresponding to the "(4)", "(7)" or "(8)" in table 1, and thus the resistance of the adjustable resistance network 12 can be increased. In other words, the resistances of the resistors in the PTAT current branch circuit of the bandgap reference power supply circuit 13 are increased, therefore the PTAT current is decreased and the top point of the TC characteristic curves can move towards the high temperature area.

Therefore, the adjustable resistance network 12 can effectively inhibit the impact that the fluctuation of the fabrication process of the resistors, the BJTs, and the MOSs in the reference power supply circuit 13 have on the temperature drift characteristic of the reference voltage.

It is to be notated that the adjustable resistance network shall not be limited to the circuit structure described in the embodiment. In other exemplary embodiments, for example, a switch PMOS transistor can be used as the switch NMOS transistor, or one or more sets of selection unit can be added for increasing the adjustable range of the resistance. The bandgap reference power supply circuit shall not be limited to the circuit structure described in the embodiment. In other exemplary embodiment, other bandgap reference power supply circuits with curvature compensations could be used, and the resistors in the branch circuit, through which the PTAT current flows, of the bandgap reference power supply circuit can be substituted by the resistors in the adjustable resistance network 12. In the case of the process change, the PTAT current can be adjusted by changing the resistance of the adjustable resistance network 12, so as to improve the temperature drift characteristic of the output reference voltage and increase the precision and stability of the reference voltage.

The above-mentioned reference power supply circuit including the adjustable resistance network 12 and the bandgap reference power supply circuit 13 can provide the reference voltage with high precision and high stability for analog circuits, such as ADC, DAC, DRAM, Flash memory. However, in the case of high frequency analog circuits (such as a ADC of 10 bits and 100 MHz), the PSRR in high frequency condition can be improved by adding one pole in the PSRR transmission function for eliminating one zero point. Specifically, the PSRR characteristic of the reference power supply circuit in high frequency condition can be enhanced by adding a compensation circuit 14 to the output end of the bandgap reference power supply circuit 13.

As shown in FIG. 3, in accordance with the exemplary embodiment, the reference power supply circuit further includes a compensation circuit 14 which is connected with the output end of the reference voltage for improving the PSRR characteristic of the reference voltage in high frequency condition. The compensation circuit 14 includes a compensation capacity C and a third NMOS transistor MN3, the compensation capacity C is connected in parallel with the seventh resistor R17, that is, a first end of the compensation capacity C is connected with the drain of the sixth PMOS transistor MP6 and a second end thereof is grounded. For the third NMOS transistor MN3, the first bias voltage PD is coupled at the gate, the drain is connected with the drain of the sixth PMOS transistor MP6 and the source is grounded.

The PSRR characteristic of the reference power supply circuit in high frequency can be improved by adding the compensation capacity C to the output end of the bandgap reference power supply circuit 13. The principle could be: in case that reference power supply circuit does not include the compensation capacity C, the PSRR transmission function is $H_{PSRR}=H_0\cdot(s-Z)$, in which s indicates the frequency and z indicates the frequency at the zero point. When the working frequency is higher than the frequency at the zero point, the PSRR will be increased with the increase of s. After adding the compensation capacity C, i.e., adding poles in the PSRR transmission function, the PSRR transmission function is $$H_{PSRR} = H_0 \cdot \frac{(s-Z)}{(s-P)},$$

in which P indicates the frequency at the pole, and when P=Z, the pole eliminates the zero point, the transmission function is approximately a constant, thus inhibiting the increase of the PSRR in high frequency conditions.

Figure 4:
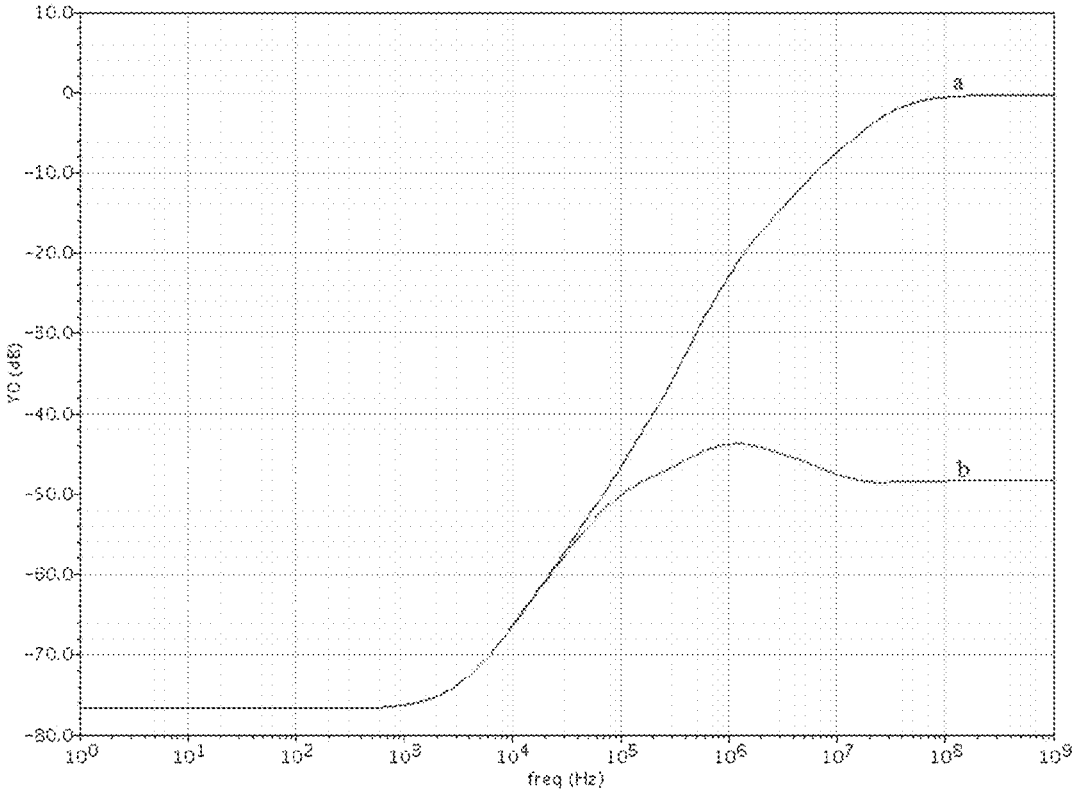
FIG. 4 is a schematic diagram for comparing a simulation curve of PSRR characteristic of the reference power supply circuit shown in FIG. 3 and a simulation curve of PSRR characteristic of a reference power supply circuit without a compensation capacity.

FIG. 4 is a schematic diagram for comparing a simulation curve "b" of the PSRR characteristic of a reference power supply circuit with a compensation capacity (in FIG. 3) and a simulation curve "a" of the PSRR characteristic of a reference power supply circuit without a compensation capacity, and which are obtained by circuit simulation under the process conditions that VDD=1.8V, temp=27° C., and 0.18 μm Logic. Referring to the simulation curve "a", PSRR (Y0) is increased with the increasing of frequency, and the PSRR approximately approaches to 0 dB at a frequency of 1 GHz. Referring to the simulation curve "b", in high frequency conditions (which is greater than 10 MHz), the PSRR becomes substantially stable to about −60 dB. Apparently by comparing the simulation curve "a" with the simulation curve "b", in high frequency conditions, the PSRR characteristic of the reference power supply circuit with a compensation capacity is better than that of the reference power supply circuit without a compensation capacity.

The above-mentioned first bias voltage PD is applied on the gate of the NMOS transistor for ensuring the normal operations of the bandgap reference power supply circuit 13 and the compensation circuit 14, and the first bias voltage PD can be preset according to the actual circuit structure, the fabrication process of NMOS transistor, ect., and also can be supplied by a starting circuit 11 as shown in FIG. 3.

As shown in FIG. 3, the reference power supply circuit of the embodiment further includes a starting circuit 11 which is connected with the bandgap reference power supply circuit 13 and the compensation circuit 14 for supplying the first bias voltage PD, thus ensuring that the bandgap reference power supply circuit 13 and the compensation circuit 14 can be operated at normal mode when the system is started (power on).

The starting circuit 11 includes an inverter 11*a*, a seventh PMOS transistor MP7, an eighth PMOS transistor MP8, a ninth PMOS transistor MP9, a fourth NMOS transistor MN4 and a first capacity C1.

A bias signal PDB is coupled at the input end of the inverter 11*a* and an inversed bias signal is output at the output end thereof, in which the inverter 11*a* has the first bias voltage PD. The inverter 11*a* is a CMOS inverter which includes a PMOS transistor and a NMOS transistor.

For the seventh PMOS transistor MP7, the gate is connected with the input end of the inverter 11*a* (i.e. inputting the bias signal PDB), the source is connected with the voltage source VDD and the drain is connected with the drain of the eighth PMOS transistor MP8.

For the eighth PMOS transistor MP8, the gate is connected with the output end of the operational amplifier A1 of the bandgap reference power supply circuit 13, the source is connected with the voltage source VDD and the drain is connected with the gate of the ninth PMOS transistor MP9.

For the ninth PMOS transistor MP9, the gate is connected with the drain of the eighth PMOS transistor MP8, the source is connected with the voltage source VDD and the drain is connected with the drain of the fourth PMOS transistor MP4 of the bandgap reference power supply circuit 13.

For the fourth NMOS transistor MN4, a second bias voltage VN is inputted at the gate, the drain is connected with the gate of the ninth PMOS transistor MP9 and a source is grounded.

A first end of the first capacity C1 is connected with the drain of the fourth NMOS transistor MN4, and a second end thereof is grounded.

It should be understood by those skilled in the art that the bias signal PDB and the second bias voltage VN provided for the starting circuit 11 can be preset according to the circuit structure and the MOS transistor fabrication process, which will not be described in detail herein.

Overall, in the reference power supply circuit described above, the adjustable design of the resistance in the branch circuit, through which the positive PTAT current flows, of the bandgap reference power supply circuit, is implemented by utilizing the adjustable resistance network, so that the fluctuating range of the resistance can meet the design requirement, and the adjustable design of the resistance of the adjustable resistance network is implemented by adopting a digital circuit, which is of simple structure and easy to be realized, so as to facilitate the adjustment and test of the circuit.

The above preferred embodiments are used to describe the present invention and are not tend to limit the present invention. Possible variations and modifications can be made by those skilled in the art without departing from the principle of the present invention. Accordingly, the scope of protection of the present invention is intended to be defined by the scope of the following claims.

The invention claimed is:

1. A reference power supply circuit comprising:

an adjustable resistance network comprising a first resistor end and a second resistor end, the resistance between the first resistor end and the second resistor end varies with a process deviation; and a bandgap reference power supply circuit connecting the first resistor end with the second resistor end, for generating a positive proportional to absolute temperature current flowing through the first resistor end and the second resistor end, and for outputting a reference voltage related to the positive proportional to absolute temperature current, wherein the adjustable resistance network comprises a plurality of sets of selection units having identical structures between the first resistor end and the second resistor end for selecting different resistance according to an input control signal, the plurality of sets of selection units further including:

a first set of selection unit having a first switch NMOS transistor, a second switch NMOS transistor and a first resistor, a second set of selection unit having a third switch NMOS transistor, a fourth switch NMOS transistor and a second resistor, and a third set of selection unit having a fifth switch NMOS transistor, a sixth switch NMOS transistor and a third resistor.

2. The reference power supply circuit according to claim 1, wherein:

drains of the first switch NMOS transistor and the second switch NMOS transistor are the first resistor end, a first control signal is inputted at the gate of the first switch NMOS transistor, an inversed signal of the first control signal is inputted at the gate of the second switch NMOS transistor, the source of the first switch NMOS transistor is connected with a first end of the first resistor, and a second end of the first resistor is connected with the source of the second switch NMOS transistor;

drains of the third switch NMOS transistor and the fourth switch NMOS transistor are connected with the second end of the first resistor, a second control signal is inputted at the gate of the third switch NMOS transistor, an inversed signal of the second control signal is inputted at the gate of the fourth switch NMOS transistor, the source of the third NMOS transistor switch is connected with a first end of the second resistor, and a second end of the second resistor is connected with the source of the fourth NMOS transistor switch;

drains of the fifth switch NMOS transistor and the sixth switch NMOS transistor are connected with the second end of the second resistor, a third control signal is inputted at the gate of the fifth switch NMOS transistor, an inversed signal of the third control signal is inputted at the gate of the sixth switch NMOS transistor, the source of the fifth NMOS transistor switch is connected with a first end of the third resistor, and a second end of the third resistor and the source of the sixth switch NMOS transistor are the second resistor end.

3. The reference power supply circuit according to claim 2, wherein the resistance of the second resistor is greater than that of the third resistor, and the resistance of the third resistor is greater than that of the first resistor.

4. The reference power supply circuit according to claim 2, wherein the on-state resistances of the first switch NMOS transistor and the second switch NMOS transistor are less than 5% of the resistance of the first resistor, the on-state resistances of the third switch NMOS transistor and the fourth switch NMOS transistor are less than 5% of the resistance of the second resistor, and the on-state resistances of the fifth switch NMOS transistor and the sixth switch NMOS transistor are less than 5% of the resistance of the third resistor.

5. The reference power supply circuit according to claim 2, wherein the bandgap reference power supply circuit comprises: a first PMOS transistor, a second PMOS transistor, a third PMOS transistor, a fourth PMOS transistor, a fifth PMOS transistor, a sixth PMOS transistor, an operational amplifier, a fourth resistor, a fifth resistor, a sixth resistor, a seventh resistor, a first NMOS transistor, a second NMOS transistor, a first PNP transistor, and a second PNP transistor, and wherein the sources of the first, second and fifth PMOS transistors are connected with a voltage source, the source of the third PMOS transistor is connected with the drain of the first PMOS transistor, the source of the fourth PMOS transistor is connected with the drain of the second PMOS transistor, the source of the sixth PMOS transistor is connected with the drain of the fifth PMOS transistor, the reference voltage is outputted at the drain of the sixth PMOS transistor;

the positive input end of the operational amplifier is connected with the drain of the third PMOS transistor and the negative input end thereof is connected with the drain of the fourth PMOS transistor, the output end of the operational amplifier is connected with the gates of the first, second, third, fourth, fifth and sixth PMOS transistors;

the first ends of the fourth resistor and the fifth resistor are connected with the drain of the third PMOS transistor, a second end of the fourth resistor is connected with the first resistor end, a first end of the sixth resistor is connected with the drain of the fourth PMOS transistor, a first end of the seventh resistor is connected with the drain of the sixth PMOS transistor, and second ends of the fifth resistor, the sixth resistor and the seventh resistor are grounded;

the drain of the first NMOS transistor and the emitter of the first PNP transistor are connected with the second resistor end, the drain of the second NMOS transistor and the emitter of the second PNP transistor are connected with the drain of the fourth PMOS transistor, the bases and collectors of the first and second PNP transistors and the sources of the first and second NMOS transistors are grounded, a first bias voltage is inputted at the gates of the first NMOS transistor and the second NMOS transistor.

6. The reference power supply circuit according to claim 5, further comprises a compensation circuit, which is connected with an output end of the reference voltage, for improving the power supply rejection ratio characteristic of the reference voltage in high frequency.

7. The reference power supply circuit according to claim 6, wherein the compensation circuit comprises a compensation capacitor and a third NMOS transistor, the compensation capacitor and the seventh resistor are connected in parallel; in the third NMOS transistor, the first bias voltage is inputted at the gate, the drain is connected with the drain of the sixth NMOS transistor, and the source is grounded.

8. The reference power supply circuit according to claim 5, further comprises a starting circuit, which is connected with the bandgap reference power supply circuit for providing the first bias voltage for the bandgap reference power supply circuit.

9. The reference power supply circuit according to claim 8, wherein the starting circuit comprises an inverter, a seventh PMOS transistor, a eighth PMOS transistor, a ninth PMOS transistor, a fourth NMOS transistor and a first capacitor, wherein the inverter outputs the first bias voltage;

the gate of the seventh PMOS transistor is connected with the input end of the inverter, the gate of the eighth PMOS transistor is connected with the output end of the operational amplifier, the drain of the ninth PMOS transistor is connected with the negative input end of the operational amplifier, and the sources of the seventh, eighth and ninth PMOS transistors are connected to the voltage source;

the drains of the seventh and eighth PMOS transistors, the gate of the ninth PMOS transistor and the drain of the fourth NMOS transistor are connected with a first end of the first capacitor, a second end of the first capacitor and the source of the fourth NMOS transistor are grounded, and a second bias voltage is inputted at the gate of the fourth NMOS transistor.

10. A reference power supply circuit comprising:

an adjustable resistance network having connection selectively variable resistances in accordance with the fabrication process thereof and control signals applied thereto; and a bandgap reference power supply circuit connecting to the adjustable resistance network, for generating a positive proportional to absolute temperature current for the adjustable resistance network, and outputting a reference voltage related to the positive proportional to absolute temperature current;

wherein the adjustable resistance network comprises a plurality of sets of selection units having identical structures between the first resistor end and the second resistor end for selecting different resistance according to an input control signal, the plurality of sets of selection units further including:

a first set of selection unit having a first switch NMOS transistor, a second switch NMOS transistor and a first resistor, a second set of selection unit having a third switch NMOS transistor, a fourth switch NMOS transistor and a second resistor, and a third set of selection unit having a fifth switch NMOS transistor, a sixth switch NMOS transistor and a third resistor.

11. The reference power supply circuit according to claim 6, further comprises a starting circuit, which is connected with the bandgap reference power supply circuit for providing the first bias voltage for the bandgap reference power supply circuit.

12. The reference power supply circuit according to claim 7, further comprises a starting circuit, which is connected with the bandgap reference power supply circuit for providing the first bias voltage for the bandgap reference power supply circuit.

* * * * *